US006525701B1

(12) United States Patent
Kang

(10) Patent No.: US 6,525,701 B1
(45) Date of Patent: Feb. 25, 2003

(54) METHOD FOR DRIVING PLASMA DISPLAY PANEL

(75) Inventor: Seong Ho Kang, Taegu-Kwangyokshi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/362,689

(22) Filed: Jul. 29, 1999

(30) Foreign Application Priority Data

Jul. 31, 1998 (KR) ..... 98-31201

(51) Int. Cl.[7] ..... G09G 3/28

(52) U.S. Cl. ..... 345/60; 345/55; 345/67; 345/66

(58) Field of Search ..... 345/60, 62, 63, 345/67, 55, 99

(56) References Cited

U.S. PATENT DOCUMENTS

| | | | | |
|---|---|---|---|---|
| 5,446,334 A | | 8/1995 | Kanazawa | |
| 5,739,804 A | * | 4/1998 | Okumura et al. | 345/99 |
| 5,841,413 A | * | 11/1998 | Zhu et al. | 345/63 |
| 5,963,184 A | * | 10/1999 | Tokunaga et al. | 345/60 |
| 6,084,559 A | * | 7/2000 | Nagao et al. | 345/67 |
| 6,104,361 A | * | 8/2000 | Rutherford | 345/55 |
| 6,140,984 A | * | 10/2000 | Kanazawa et al. | 345/67 |

FOREIGN PATENT DOCUMENTS

| | | |
|---|---|---|
| JP | 08-129357 | 5/1996 |
| JP | 09-160525 | 6/1997 |
| JP | 10-003281 | 1/1998 |

* cited by examiner

*Primary Examiner*—Dennis-Doon Chow
*Assistant Examiner*—Alecia Nelson
(74) *Attorney, Agent, or Firm*—Fleshner & Kim, LLP

(57) ABSTRACT

Method for driving a plasma display panel, the panel having scan electrode lines and sustain electrode lines disposed alternatively on an effective display area of a substrate, a first black matrix formed on a region between even numbered scan electrode lines and odd numbered sustain electrode lines, and a second matrix formed on a region between odd numbered scan electrode lines and even numbered sustain electrode lines, the method, during a reset discharge period, including the steps of (1) conducting an erase discharge at a region under the first black matrix formed between the odd numbered scan electrode lines and the even numbered sustain electrode lines, and (2) conducting an erase discharge at a region under the second black matrix formed between the even numbered scan electrode lines and the odd numbered sustain electrode lines, thereby inducing a reset discharge that makes all wall charge states of cells uniform to occur at a position under a black matrix during a reset period, whereby significantly improving a contrast.

20 Claims, 12 Drawing Sheets

METHOD FOR DRIVING PLASMA DISPLAY PANEL

BACKGROUND OF THE INVENTION

1. Field of the Invention

The present invention is related to a method for driving a plasma display panel, and more particularly, to a method for driving a plasma display panel, in which a reset discharge that makes all wall charge states of cells uniform is induced to occur at a position under a black matrix during a reset period for improving a contrast.

2. Background of the Related Art

The plasma display panel and LCD(Liquid Crystal Display) are spotlighted as next generation displays of the greatest practical use, and, particularly, the plasma display panel has wide application as a large sized display, such as an outdoor signboard, a wall mounting type TV, a display for a movie house because the plasma display panel has a higher luminance and a wide angle of view than the LCD.

As shown in FIG. 1A, a general plasma display panel of triode surface discharge type has an upper substrate 10 and a lower substrate 20 bonded together facing each other. FIG. 1B illustrates a section of a plasma display panel shown in FIG. 1A, wherein the lower substrate 20 is shown with a face of the lower substrate 20 rotated by 90° for convenience of explanation.

The upper substrate 10 is provided with scan electrodes 16 and 16' and sustain electrodes 17 and 17' formed in parallel, and a dielectric layer 11 and a protection film 12 each coated on the scan electrodes 16 and 16' and the sustain electrodes 17 and 17' in succession, the lower substrate 20 is provided with address electrodes 22, a dielectric film 21 formed on an entire surface of the substrate inclusive of the address electrodes 22, barriers 23 formed on the dielectric film 21 between the address electrodes 22, and a fluorescent material 24 coated on surfaces of the barrier 23 and the dielectric film 21 in each of the discharge cells, and a space between the upper substrate 10 and the lower substrate 20 is filled with a mixture of inert gases, such as helium or xenon, at a pressure in a range of 400 to 500 Torr, to form a discharge region. In general, the inert gas filled in the discharge space in a DC plasma display panel is a mixture of helium and xenon, and the inert gas filled in the discharge space in an AC plasma display panel is a mixture of neon and xenon.

As shown in FIGS. 2A and 2B, the scan electrodes 16 and 16' and the sustain electrodes ma 17 and 17' are transparent electrodes 16 and 17 or bus electrodes 16' and 17' of a metal for increasing a light transmittivity of the discharge cells. FIG. 2A illustrates a plan view of the sustain electrodes 17 and 17' and the scan electrodes 16 and 16', and FIG. 2B illustrates a section of the sustain electrodes 17 and 17' and the scan electrodes 16 and 16'. The bus electrodes 16' and 17' have a discharge voltage provided thereto from an external driver IC, and the transparent electrodes 16 and 17 have the discharge voltage provided to the bus electrodes 16' and 17' provided thereto, for causing a discharge between adjacent transparent electrodes 16 and 17. The transparent electrode 16 and 17 has a total width of approx. 300 $\mu$m, and formed of indium oxide or tinoxide, and the bus electrode 16' and 17' has a thin film of three layers of Cr—Cu—Cr. The but electrode 16' and 17' has a line width which is approx. ⅓ of a line width of the transparent electrode 16 and 17.

FIG. 3 illustrates a wiring for the scan electrodes Sm−1, Sm, Sm+1, - - - , Sn−1, Sn, Sn+1 and the sustain electrodes Cm−1, Cm, Cm+1, - - - , Cn−1, Cn, Cn+1, formed on the upper substrate, wherein the scan electrodes are insulated from one another, while all of the sustain electrodes are connected in parallel. Particularly, an area shown by dotted line in FIG. 3 denotes an effective area in which an image is displayed, and the other area denotes a non-effective area in which no image is displayed. The scan electrodes disposed in the non-effective area are called dummy electrodes 26, of which number is not limited, especially.

The operation of the aforementioned AC plasma display panel of a triode surface discharge type will be explained with reference to FIGS. 4A~4D.

Referring to FIG. 4A, upon application of a driving voltage between the address electrode and the scan electrode, an opposed discharge takes place between the address electrode and the scan electrode. This-opposed discharge produces ions as the inert gas filled in the discharge cell is excited momentarily and transited to a ground state, and a portion of ions, or atoms in a quasi-excited state, generated in this time, is collided at surfaces of the protection layer as shown in FIG. 4B. These electron collision cause emission of secondary electrons from surfaces of the protection layer. The secondary electrons collide at a plasma state gas, which spreads the discharges. Upon finish of the opposed discharge between the address electrode and the scan electrode, wall charges of opposite polarities are formed at respective protection layer surfaces of the address electrode and the scan electrode as shown in FIG. 4C. And, as shown in FIG. 4D, if the driving voltage provided to the address electrode is cut off while the discharge voltages of opposite polarities are kept provided to the scan electrodes and the sustain electrodes, a surface discharge caused by a potential difference between the scan electrodes and the sustain electrodes takes place in a discharge region of surfaces of the dielectric layer and the protection layer. These opposed discharge and the surface discharge causes electrons present in the discharge cell to collide onto the inert gas in the discharge cell, to excite the inert gas in the discharge cell to emit a UV ray with a wavelength of 147 nm in the discharge cell. The UV ray collides onto the fluorescent material coated on the address electrode and the barrier, to excite the fluorescent material, to emit a visible light, that forms an image on a screen. One pixel has a discharge cell of a red fluorescent material, a discharge cell of a green fluorescent material, and a discharge cell of a blue fluorescent material. By controlling a number of discharges in each of the discharge cells, the plasma display panel implements a gradation of an image. In this instance, the discharges taken place in each of the discharge cells consists of the address discharge for initiating a discharge, a sustain discharge for sustaining a discharge of the discharge cell, and an erase discharge for stopping the discharge of the discharge cell. Though there are a sub-field method and a sub-frame method in methods for driving a plasma display panel for implementing an image using those address discharge, the sustain discharge, and the erase discharge, a driving method widely used generally is an ADS(Address Display Separating) sub-field method in which an address discharge period and a sustain discharge period are separated. In order to implement a $2^X$ gradation in the ADS sub-field method, one frame of image is divided into Y sub-field frames of images before displaying the image, and an external video data is digitized into an X bit digital video data before the external video data is provided to the plasma display panel(where, $X \leqq Y$). And, each sub field frame consists of a reset period, an address period, and a sustain period. Identical reset period and address period are assigned to every sub field. Different sustain periods are assigned to the sub fields depending on a weighted value of bits of the digital video data to be displayed in the address period. Therefore, a combination of the sub fields implements a gradation of the image. As an example, as shown in FIG. 5, when one frame is divided into 8 sub fields(SF1, SF2, SF3, SF4, SF5, SF6, SF7 and SF8), and luminances of 1, 2, 4, 8, 16, 32, 64, and 128 are corresponded, a combination of some of the sub fields facilitates to implement a gradation data with a gradation ranging 0~255.

In the meantime, because there are cells discharged, and cells not discharged in a prior frame coexistent in the reset period, all the discharge cells should be discharged for making all wall charge states uniform. To do this, a reset pulse $V_w$ is applied to the sustain electrode C as shown in FIG. 6. Since a reset pulse voltage $V_w$ is higher than a discharge starting voltage $V_f$ between the scan electrode Sm, Sm−1, Sn−1 and Sn and the sustain electrode, a discharge takes place at an rising edge, which is maintained for 5 $\mu$s~15 $\mu$s, to form adequate wall charges. These wall charges cause discharges again at a falling edge of the reset pulse, to neutralize the wall charges, that makes the wall charge states uniform.

However, the non-uniform discharge voltages between discharge cells coming from thickness differences of non-uniform fluorescent material layers, and pressure differences of the inert gas, which exist inevitably between the discharge cells, cause the wall charges to remain even after application of the reset pulse. There is an erase period in which erase pulses are applied to the scan electrodes Sm, Sm−1, Sn−1, Sn, - - - within the effective area after the reset period in which reset pulses are applied for erasing the remained wall charges. In the erase period, small amounts of wall charges remained at the sustain electrodes are neutralized, and erased in succession by the erase pulses. Then, during the address period, a scan pulse is applied to the scan electrodes one by one in succession, and a wall charge is formed as a cell of a designated pixel is discharged on application of a data pulse to the address electrode, and, during the sustain period, a luminance of the pixel having a discharge occurred during the address period is sustained as a sustain pulse proportional to a relative luminance ratio of the scan electrode and the sustain electrode is provided. Though the foregoing reset discharge is not required for implementation of gradation in the related art sub field driving method, the reset discharge is essential for a stable discharge. However, in the related art sub field method, the exposure of visible lights from the reset discharge increases a luminance of the black image, which reduces a contrast of the image.

SUMMARY OF THE INVENTION

Accordingly, the present invention is directed to a method for driving a plasma display panel that substantially obviates one or more of the problems due to limitations and disadvantages of the related art.

An object of the present invention is to provide a method for driving a plasma display panel, which can cut off an exposure of a visible light from a reset discharge, for reducing a luminance of a black image in a plasma display panel, that improves a contrast of an image.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the method for driving a plasma display panel includes the steps of (1) conducting an erase discharge at a region under the first black matrix formed between the odd numbered scan electrode lines and the even numbered sustain electrode lines, and (2) conducting an erase discharge at a region under the second black matrix formed between the even numbered scan electrode lines and the odd numbered sustain electrode lines.

The method for driving a plasma display panel further includes the steps of (3) maintaining a potential difference between the odd numbered scan electrode lines and the odd numbered sustain electrode lines to a level which causes no discharge during the time when the erase discharge is taken place between the odd numbered scan electrode lines and the even numbered sustain electrode lines, and (4) maintaining a potential difference between the even numbered scan electrode lines and the even numbered sustain electrode lines to a level which causes no discharge during the time when the erase discharge is taken place between the even numbered scan electrode lines and the odd numbered sustain electrode lines.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings.

Figure 1A:
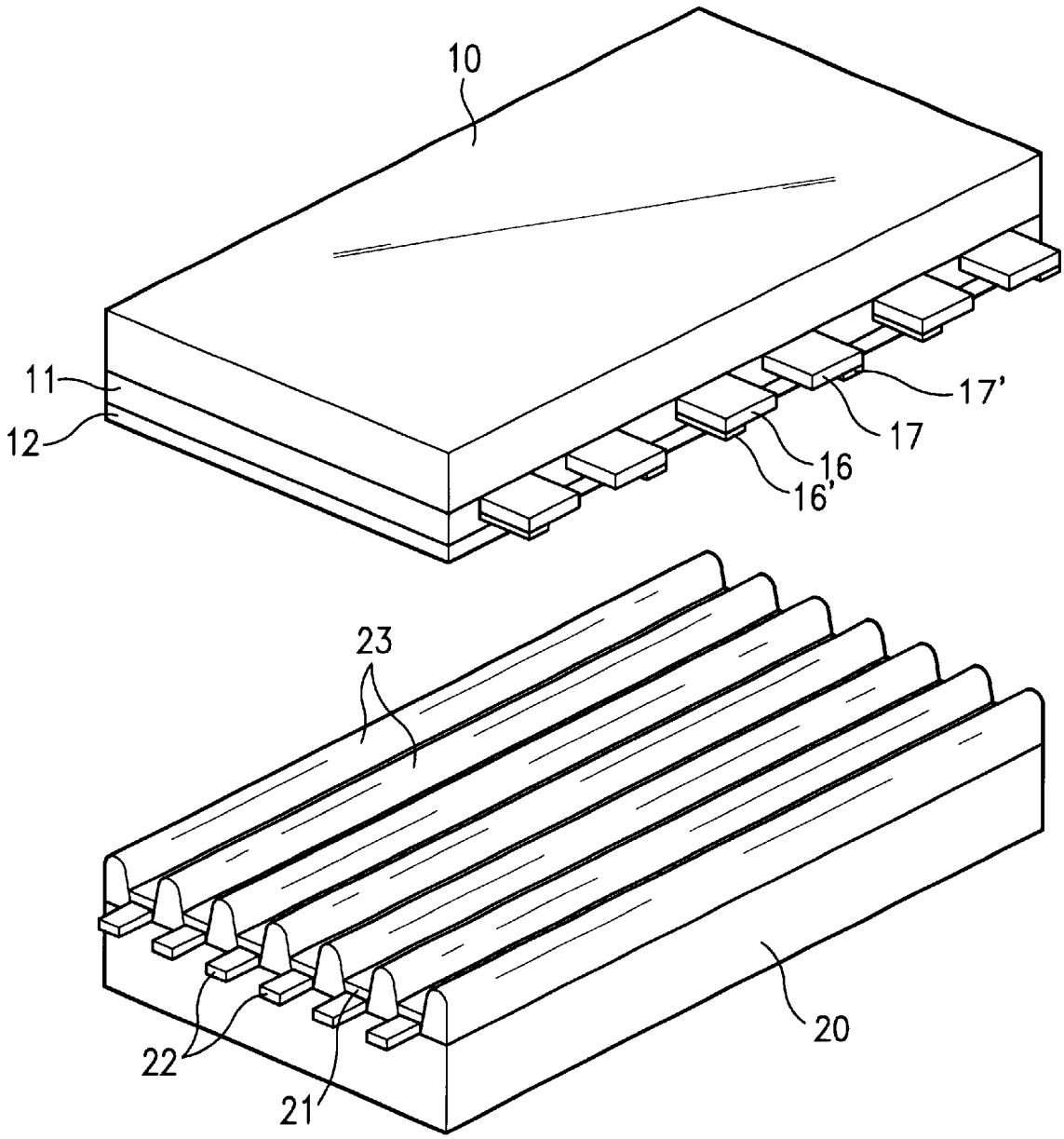
FIG. 1A Related Art
FIGS. 1A and 1B illustrate structures of a related art plasma display panel, respectively.
Figure 1B:
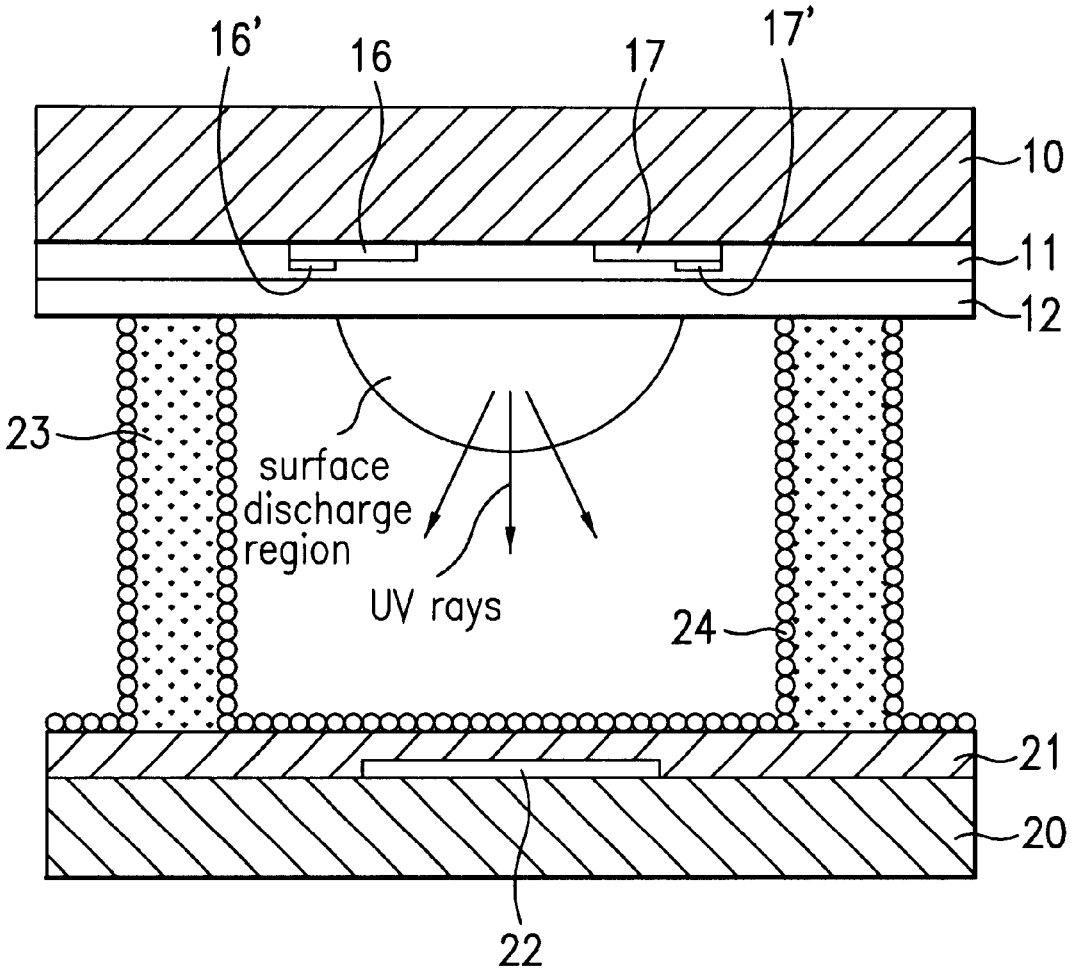
FIG.1B Related Art
Figure 2A:
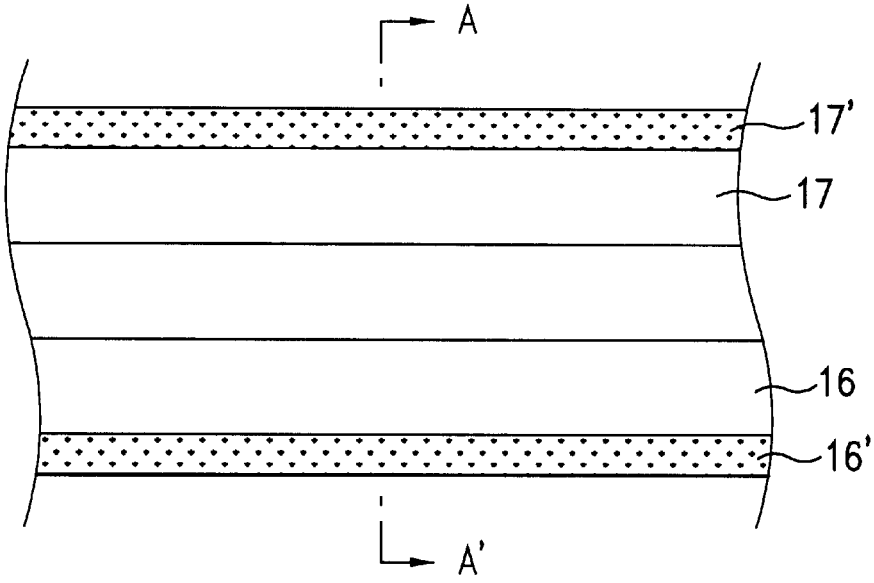
FIG.2A Related Art
FIGS. 2A and 2B illustrate structures of a scan electrode and a sustain electrode in a related art plasma display panel, respectively.
Figure 2B:
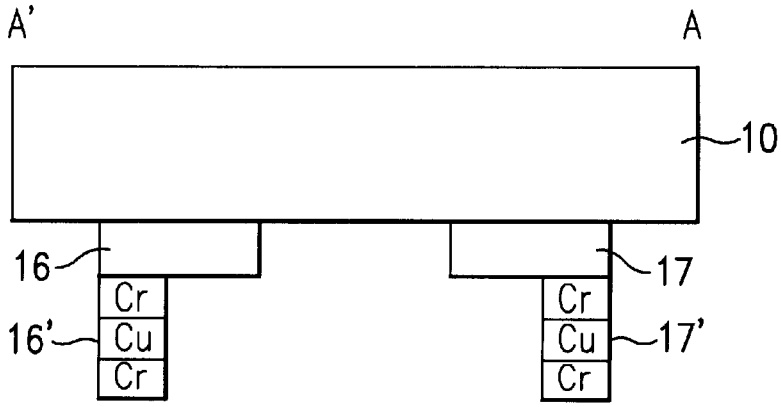
FIG.2B Related Art
Figure 3:
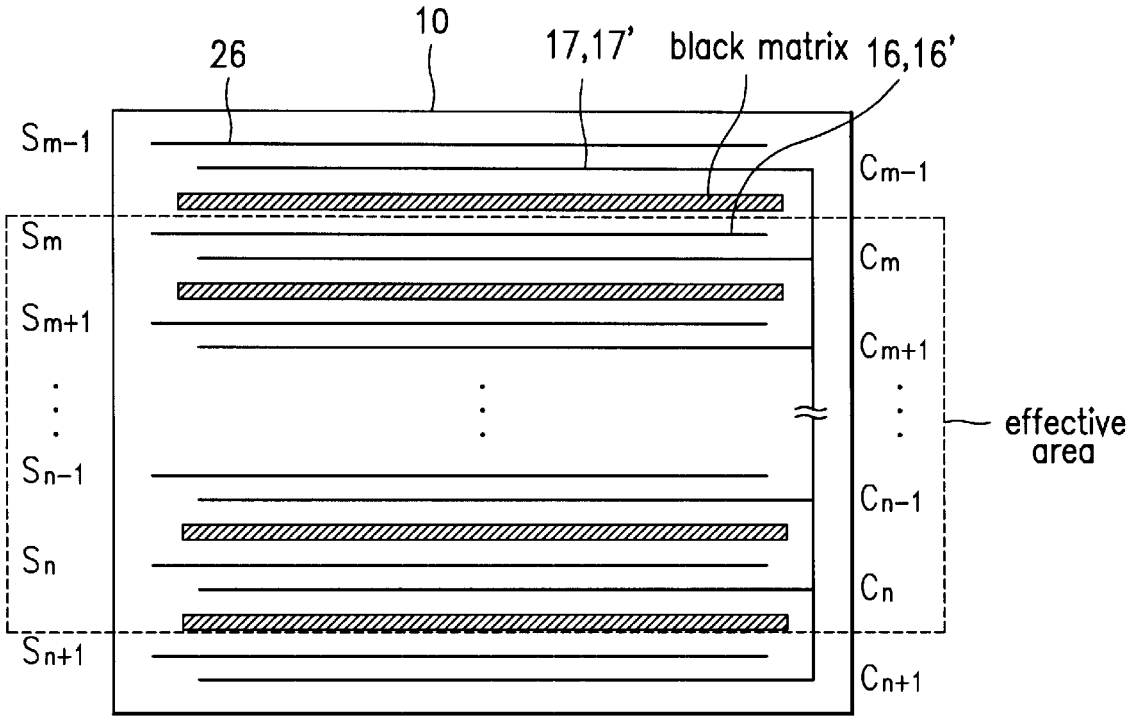
FIG.3 Related Art
FIG. 3 illustrates a wiring for scan electrodes and sustain electrodes in a related art plasma display panel.
Figure 4A:
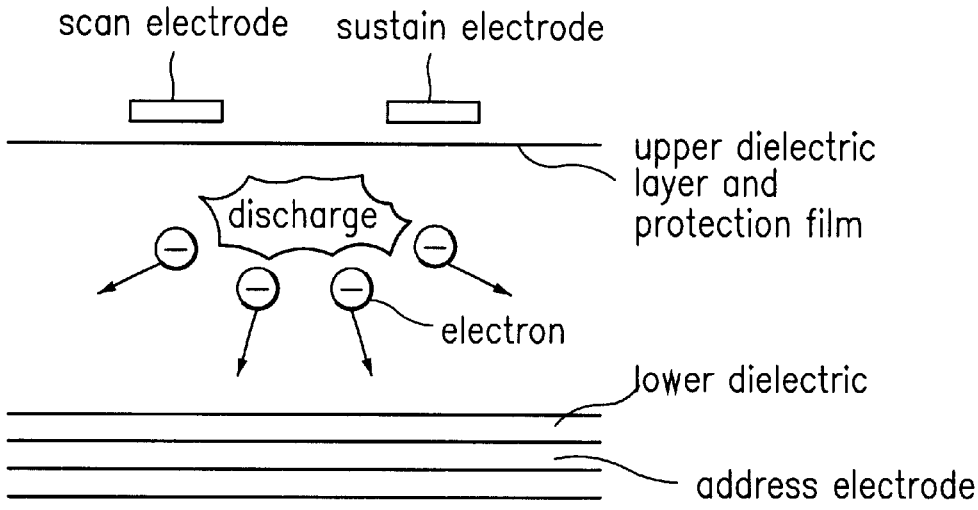
FIG.4A Related Art
FIGS. 4A~4D illustrate a discharge principle of the plasma display panel.
Figure 4B:
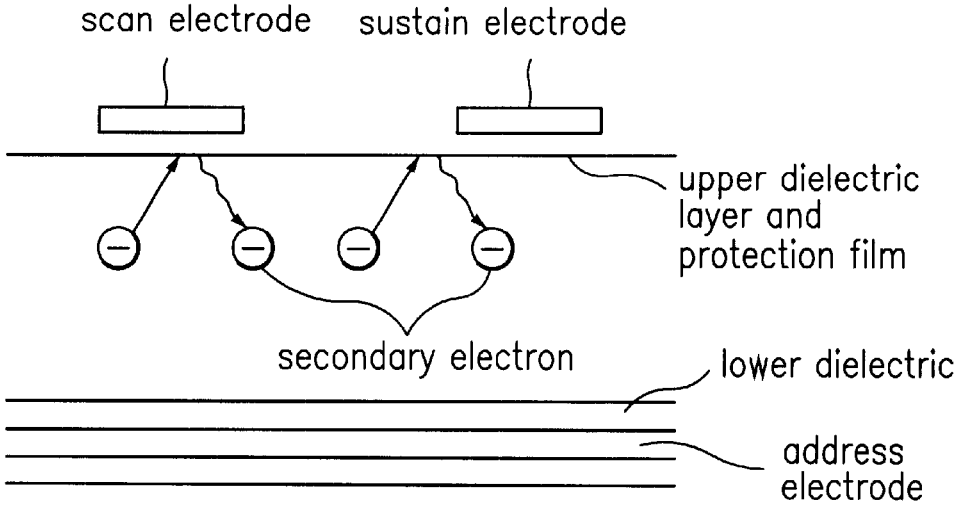
FIG.4B Related Art
Figure 4C:
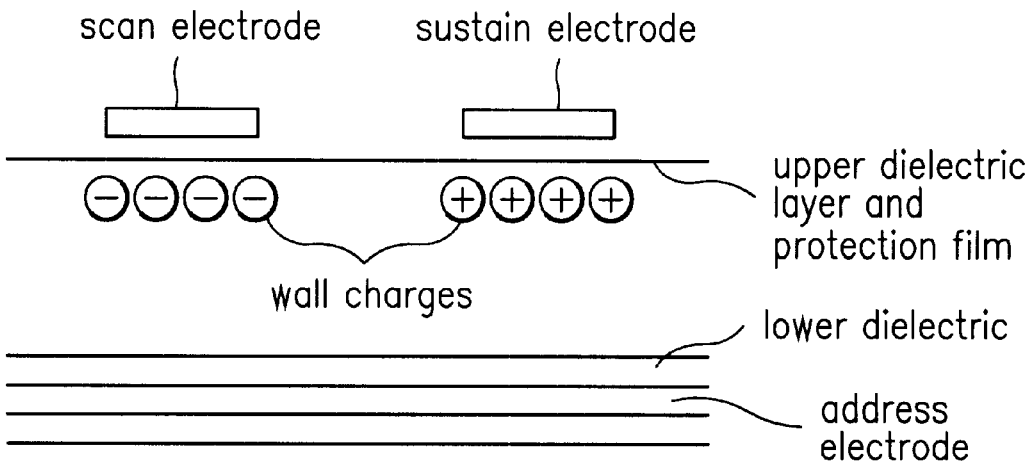
FIG.4C Related Art
Figure 4D:
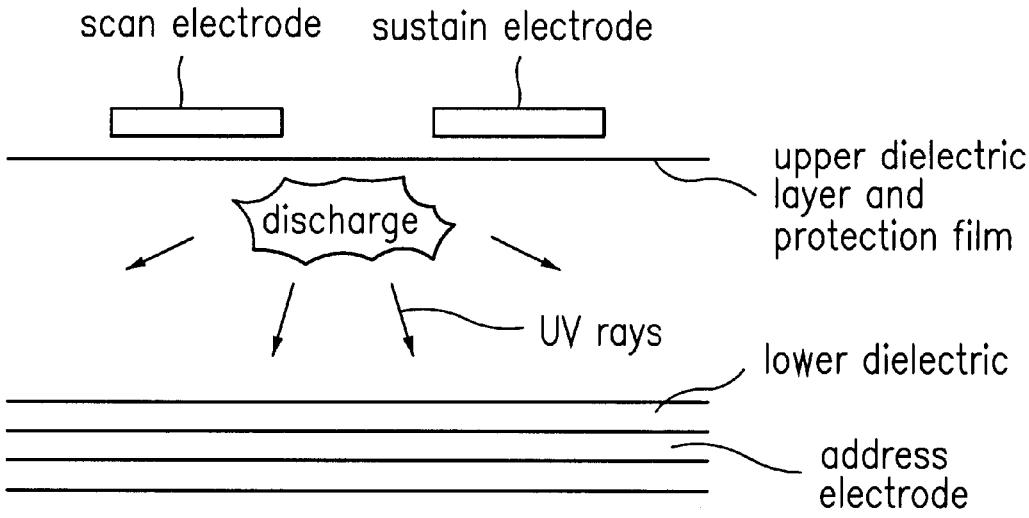
FIG.4D Related Art
Figure 5:
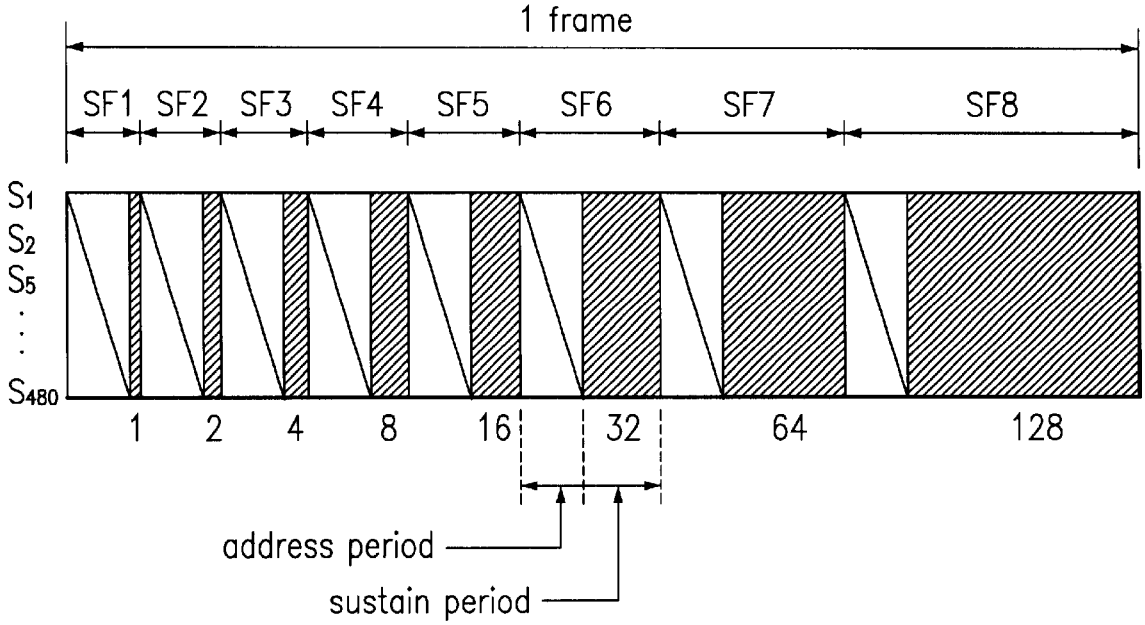
FIG.5 Related Art
FIG. 5 illustrates a sub field drive method for a related art plasma display panel.
Figure 6:
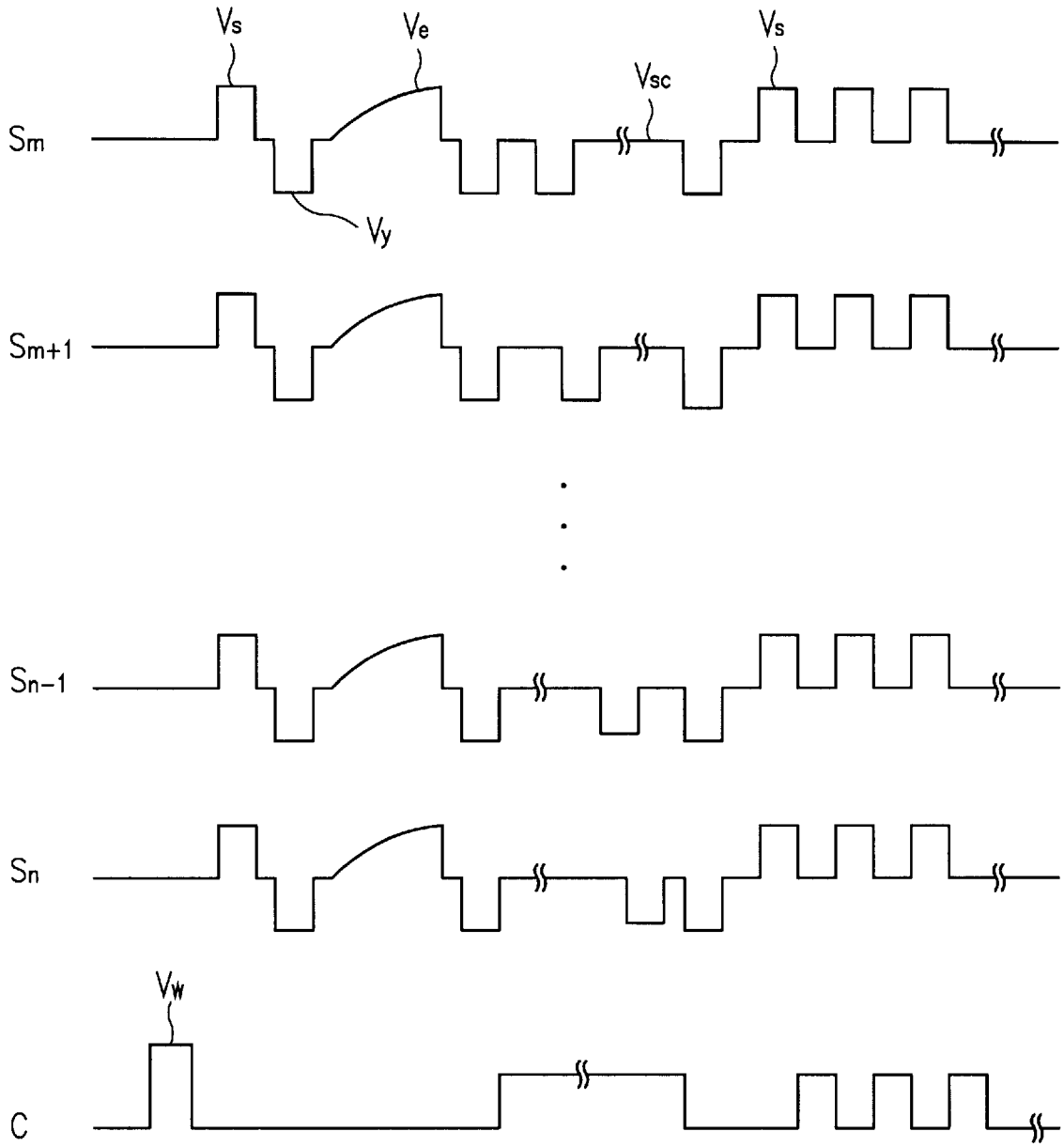
FIG.6 Related Art
FIG. 6 illustrates driving pulses for reset discharge in a plasma display panel.
Figure 8A:
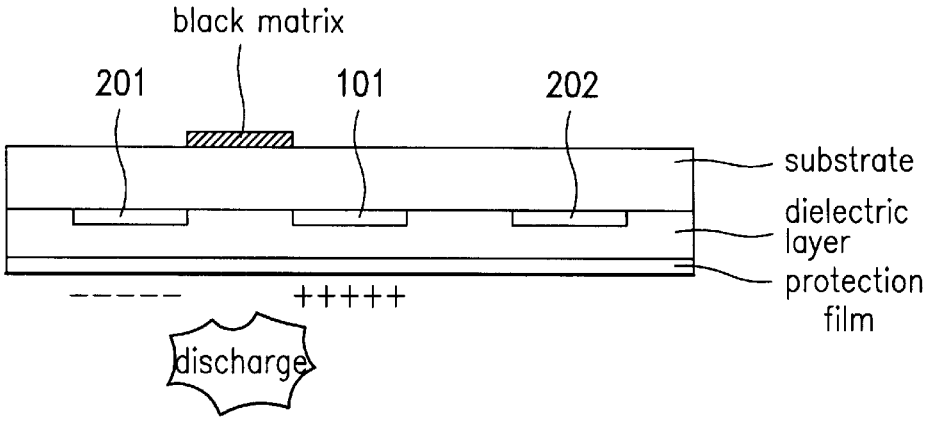
FIGS. 8A~8F illustrate a discharge cell in the plasma display panel operative in response to driving pulses of the present invention.
Figure 8B:
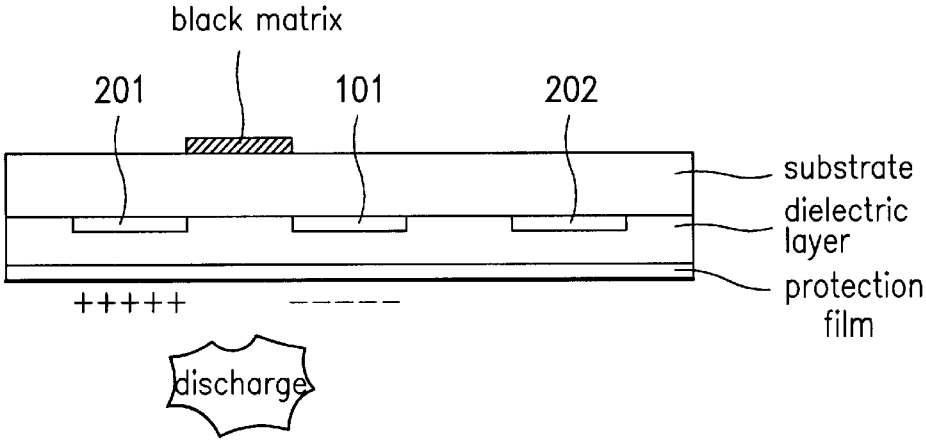
Figure 8C:
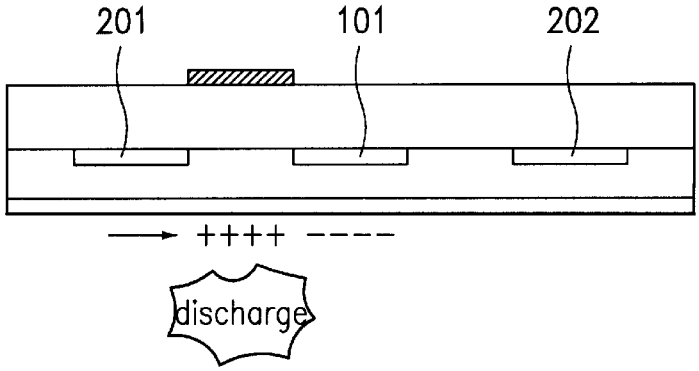
Figure 8D:
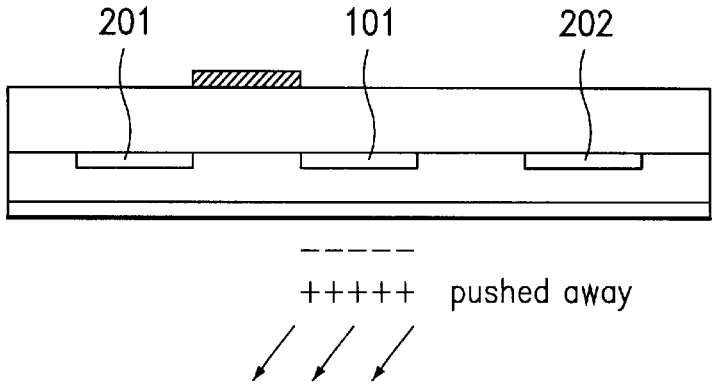
Figure 8E:
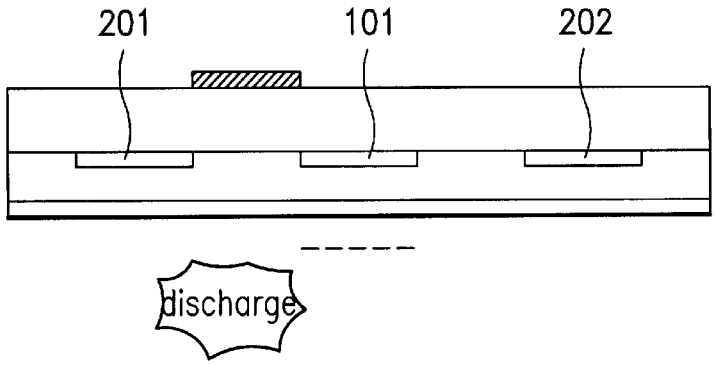
Figure 8F:
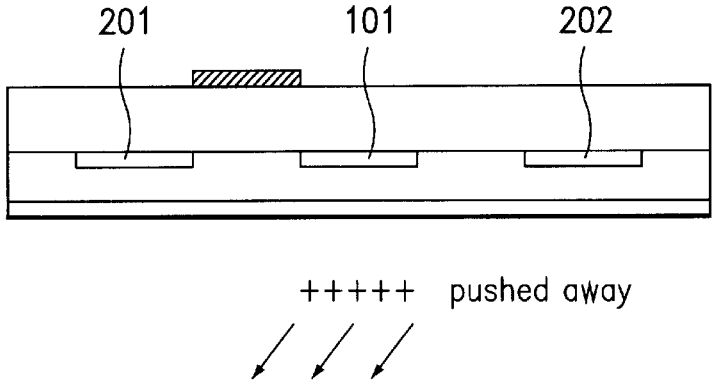

Referring to FIG. 3, a plasma display panel having a driving method of the present invention applied thereto includes scan electrode lines and sustain electrode lines disposed alternatively within an effective area of a substrate and a black matrix as shown in FIGS. 8A 8F on a region between the scan electrode lines 101 and the sustain electrode lines 201 on a back surface of the substrate where no pixel is formed. That is, the black matrix is formed on the back surface of the substrate corresponding to regions between even numbered scan electrode lines and odd numbered sustain electrode lines and regions between odd numbered scan electrode lines and even numbered sustain electrode lines on a front surface. In other words, the plasma display panel having the present invention applied thereto has a black matrix formed on a region between (2n)th scan electrode line and (2n+1)th sustain electrode line, and on a region between (2n+1)th scan electrode line and (2n)th sustain electrode line. As such structure is a general structure of a plasma display panel, a detailed explanation will be omitted.

Figure 7:
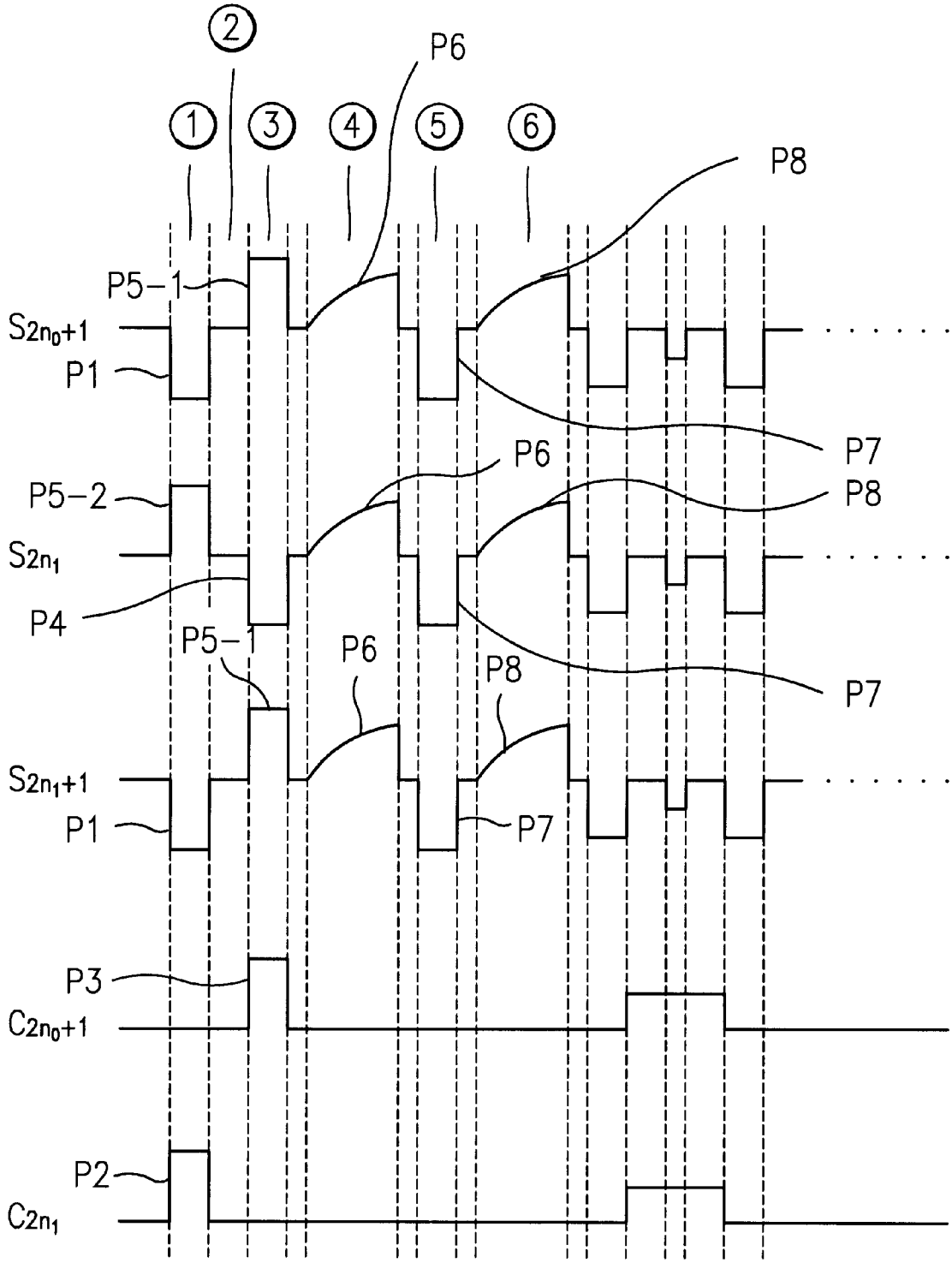
FIG. 7 illustrates driving pulses for a driving method in accordance with a preferred embodiment of the present invention.

Waveforms of pulses provided to the scan electrode lines and the sustain electrode lines for application of the driving method of the present invention are as shown in FIG. 7.

A first pulse P1 is applied to a (2n+1)th scan electrode line and, at the same time, a second pulse P2 of a polarity opposite to the first pulse P1 is applied to the (2n)th sustain electrode line for causing a discharge at a region under the black matrix between the odd numbered scan electrode line and the even numbered sustain electrode line(①). In this instance, the first pulse P1 has a voltage ranging approx. −150V~−200V, and the second pulse P2 has a voltage ranging approx. 200V~300V. As shown in FIG. 8A, a discharge takes place caused by a potential difference between the first pulse P1 and the second pulse P2 at a region between the odd numbered scan electrode line 101 having the first pulse P1 applied thereto and the even numbered sustain electrode line 201 having the second pulse P2 applied thereto. As a result of this, positive ions are collected over the odd numbered scan electrode line 101 and negative wall charges(electrons) are collected over the even numbered sustain electrode line 201. In this instance, a 5"(P5–2) pulse of a polarity identical to the second pulse is applied to an even numbered scan electrode line $S_{2n0}$. The 5"(P5–2) pulse causes no discharge to occur between the even numbered scan electrode line and the even numbered sustain electrode line, because a potential difference between the even numbered scan electrode line and the even numbered sustain electrode line is lower than a discharge initiation voltage as the 5"(P5–2) pulse has the same polarity with the second pulse. And, no discharge occurs between the odd numbered scan electrode line 101 and the odd numbered sustain electrode line 202, because a potential difference between the odd numbered scan electrode line 101, $S_{2n0+1}$ and the odd numbered sustain electrode line 202 $C_{2n0+1}$ is lower than a discharge initiation voltage. After a rising edge of the first pulse P1 and a falling edge of the second pulse P2, as shown in FIG. 8B, a potential difference by the wall charges and the ions causes a natural discharge, to swap the charges and ions over the odd numbered scan electrode line 101 and the even numbered sustain electrode line 201(②). And, after the natural discharge between the odd numbered scan electrode line $S_{2n+1}$ and the even numbered sustain electrode line $C_{2n}$ ends, a third pulse P3 is applied to a $(_{2n+1})$th sustain electrode line $C_{2n+1}$, i.e., an odd numbered sustain electrode line $C_{2n+1}$ and, at the same time, a fourth pulse P4 of a polarity opposite to the third pulse P3 is applied to the (2n)th scan electrode line S2n, i.e., an even numbered scan electrode line for causing a discharge at a region under the black matrix between the even numbered scan electrode line and the odd numbered sustain electrode line(③). In this instance, the third pulse P3 has a voltage ranging approx. 200V~300V, and the fourth pulse P4 has a voltage ranging approx. −150V~−200V. A discharge takes place caused by a potential difference between the third pulse P3 and the fourth pulse P4 at a region between the odd numbered sustain electrode line $C_{2n+}$having the third pulse P3 applied thereto and the even numbered scan electrode line $S_{2n}$ having the fourth pulse P4 applied thereto. As a result of this, positive ions are collected over the even numbered scan electrode line $S_{2n}$ and negative wall charges(electrons) are collected over the odd numbered sustain electrode line $C_{2n+1}$. After a falling edge of the third pulse P3 and a rising edge of the fourth pulse P4, a potential difference by the wall charges and the ions causes a natural discharge at a region between the even numbered scan electrode line and the odd numbered sustain electrode line $S_{2n+1}$, to swap the charges and ions over the odd numbered scan electrode line $S_{2n+1}$ and the even numbered sustain electrode line $C_{2n+1}$. In this instance, a 5'(P5–1) pulse of a polarity identical to the third pulse is applied to an odd numbered scan electrode line $S_{2n0+1}$. The 5'(P5–1) pulse causes no discharge to occur between the odd numbered scan electrode line and the odd numbered sustain electrode line, because a potential difference between the odd numbered scan electrode line and the odd numbered sustain electrode line is lower than a discharge initiation voltage as the 5'(P5–1) pulse has the same polarity with the third pulse. And, no discharge occurs between the even numbered scan electrode line and the even numbered sustain electrode line, because a potential difference between the even numbered scan electrode line $S_{2n+1}$ and the even numbered sustain electrode line $C_{2n0}$ is lower than a discharge initiation voltage. And, if necessary, a sixth pulse P6 of a polarity identical to the 5' pulse P5–1 and 5" pulse P5–2 with a moderate rising slope may be applied to the odd numbered scan electrode line $S_{2n+1}$ and the even numbered scan electrode line $S_{2n}$, i.e, to all scan electrode lines additionally in the method for driving a plasma display panel of the present invention(④). In this instance, the sixth pulse P6 has a level of voltage similar to voltages of the 5' pulse P5–1 and 5" pulse P5–2, and is applied to the odd numbered scan electrode line $S_{2n+1}$ and the even numbered scan electrode line $S_{2n}$, i.e., to all scan electrode lines, at the same time. When the sixth pulse P6 is applied to the scan electrode lines, though there are no discharges taking place at regions around the scan electrode lines, as shown in FIG. 8D, the wall charges present on the scan electrode lines 101 are pushed away to the discharge cells. As a result, only the negative wall charges are present on the protection film over the scan electrode lines 101. After application of the sixth pulse P6 to the scan electrode lines, a seventh pulse P7 of a polarity opposite to the sixth pulse P6 is applied to (2n)th scan electrode lines and (2n+1)th scan electrode lines, i.e., to all scan electrode lines, at the same time((⑤)). In this instance, the seventh pulse P7 has a voltage ranging −150V~−200V, and is applied to all the scan electrode lines, at the same time. As a result of this, the negative voltage from the wall charges over the scan electrode lines and a voltage of the seventh pulse P7 are overlapped, to induce a discharge at a region under the black matrix as shown in FIG. 8E, among regions between the scan electrode lines and the sustain electrode lines. That is, the discharge is induced at regions between the even numbered scan electrode lines $S_{2n}$ and the odd numbered sustain electrode lines $C_{2n+1}$, and between the odd numbered scan electrode lines $S_{2n+1}$ and the even numbered sustain electrode lines $C_{2n+1}$. Even though the discharge induced at regions under the black matrix caused by the application of the seventh pulse P7 erases all the wall charges theoretically, there may be a small amount of wall charges or ions over the scan electrode lines due to a minute error which exists in every discharge cell. In order to erase such ions or wall charges completely, an eighth pulse P8 of a polarity identical to the sixth pulse P6 with a moderate rising slope may be applied to the odd numbered scan electrode lines $S_{2n+1}$ and the even numbered scan electrode lines $S_{2n}$ additionally in the method for driving a plasma display panel of the present invention (⑥). Since the eighth pulse P8 has a moderate rising slope the same as the sixth pulse P6, the eighth pulse P8 induces no discharge between the scan electrode lines and the sustain electrode lines. However, as shown in FIG. 8F, the eighth pulse P8 pushes the wall charges remains on the protection film over the scan electrode lines 101 away toward the discharge cell spaces. Therefore, once the eighth pulse P8 is applied to the scan electrode lines 101, the wall charges over the scan electrode lines 101 disappear.

The application of the first pulse to eighth pulse to the scan electrode lines and the sustain electrode lines according to the method for driving a plasma display panel of the present invention can erase all the wall charges over the scan electrode lines for respective discharge cells in the plasma display panel. That is, upon application of the pulses of the present invention to the scan electrode lines and the sustain electrode lines, all the discharge cell states are initialized uniformly.

Particularly, the method for driving a plasma display panel of the present invention facilitates the discharges for making states of discharge cells uniform to occur at regions under the black matrix, to reduce a luminance of the black image in the effective area of the plasma display panel, that improves a contrast of the image, significantly.

Figure 9:
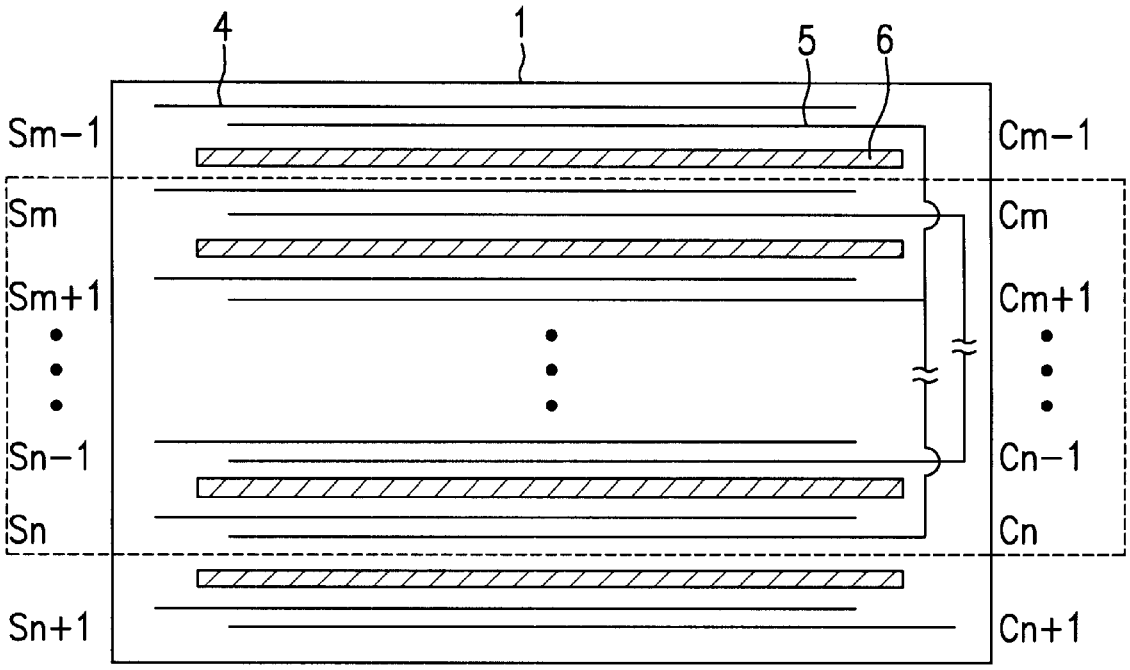
FIG. 9 illustrates a wiring for scan and sustain electrodes in a plasma display panel according to the invention.

FIG. 9 illustrates a wiring of scan and sustain electrodes in a plasma display panel according to an embodiment of the invention. The above discussed method may be practiced on the plasma display panel of FIG. 9. Referring to FIG. 9, the scan electrodes 4 $S_{m-1}$, $S_m$, $S_{m+1}$, - - - , $S_{n-1}$, $S_n$, $S_{n+1}$ are insulated from one another, while the sustain electrodes 5 $C_{m-1}$, $C_m$, $C_{m+1}$, - - - , $C_{n-1}$, $C_n$, $C_{n+1}$ are divided into two poles, odd numbered electrodes and even numbered electrodes, and then the odd and even numbered electrodes are respectively connected in parallel. Dummy electrodes $S_{m-1}$, $S_{n+1}$ formed in the circumference among the scan electrodes 4 and dummy electrodes $C_{m-1}$, $C_{n+1}$ formed in the circumference among the sustain electrodes 5 form a non-effective area on which an image is not displayed. The other electrodes form an effective area on which the image is displayed (dotted line in drawings).

In this embodiment, two dummy electrodes form the non-effective area. However, another number of electrodes for forming the non-effective area may also be appropriate.

It will be apparent to those skilled in the art that various modifications and variations can be made in the method for driving a plasma display panel of the present invention without departing from the spirit or scope of the invention. Thus, it is intended that the present invention cover the modifications and variations of this invention provided they come within the scope of the appended claims and their equivalents.

What is claimed is:

1. A method for driving a plasma display panel, the panel having scan electrode lines and sustain electrode lines disposed alternatively on an effective display area of a substrate, a first black matrix formed on a region between even numbered scan electrode lines and odd numbered sustain electrode lines, and a second black matrix formed on a region between odd numbered scan electrode lines and even numbered sustain electrode lines, the method, during a reset discharge period, comprising:

(1) conducting an erase discharge at a region under the first black matrix formed between the odd numbered scan electrode lines and the even numbered sustain electrode lines; and (2) conducting an erase discharge at a region under the second black matrix formed between the even numbered scan electrode lines and the odd numbered sustain electrode lines.

2. The method as claimed in claim 1, wherein step (1) includes applying a first pulse to the odd numbered scan electrode lines in succession and, at the same time, applying a second pulse of a polarity opposite to the first pulse to the even numbered sustain electrode lines.

3. The method as claimed in claim 2, wherein the first pulse has a voltage ranging −150V~−200V.

4. The method as claimed in claim 2, wherein the second pulse has a voltage ranging 200V~300V.

5. The method as claimed in claim 1, wherein step (2) includes applying a third pulse of a polarity opposite to the first pulse to the odd numbered sustain electrode lines in succession and, at the same time, applying a fourth pulse of a polarity opposite to the third pulse to the even numbered scan electrode lines in succession.

6. The method as claimed in claim 5, wherein the third pulse has a voltage ranging 200V~300V.

7. The method as claimed in claim 5, wherein the fourth pulse has a voltage ranging −150V~−200V.

8. The method as claimed in claim 1, further comprising:

(3) maintaining a potential difference between the odd numbered scan electrode and the odd numbered sustain electrode lines to a level which causes no discharge during the time when the erase discharge is taking place between the odd numbered scan electrode lines and the even numbered sustain electrode lines; and (4) maintaining a potential difference between the even numbered scan electrode lines and the even numbered sustain electrode lines to a level which causes no discharge during the time when the erase discharge is taking place between the even numbered scan electrode lines and the odd numbered sustain electrode lines.

9. The method as claimed in claim 8, wherein step (3) includes applying a fifth pulse to the odd numbered scan electrode lines.

10. The method as claimed in claim 9, wherein the fifth pulse has a voltage ranging 150V~200V.

11. The method as claimed in claim 8, wherein step (4) includes applying a fifth pulse to the even numbered scan electrode lines.

12. The method as claimed in claim 11, wherein the fifth pulse has a voltage ranging 150V~200V.

13. The method as claimed in claim 8, further including applying a sixth pulse to all the scan electrode lines for removing the wall charges present at regions over the scan electrode lines.

14. The method as claimed in claim 13, wherein the sixth pulse has a moderate slope so as not to cause a discharge.

15. The method as claimed in claim 13, further including:

(5) causing a discharge at a region between the even numbered scan electrode lines and the even numbered sustain electrode lines; and (6) causing a discharge at a region between the odd numbered scan electrode lines and the odd numbered sustain electrode lines.

16. The method as claimed in claim 15, wherein steps (5) and (7) include applying a seventh pulse to the even numbered scan electrode lines and odd numbered scan electrode lines at the same time.

17. The method as claimed in claim 16, wherein the seventh pulse has a voltage ranging −150V~−200V.

18. The method as claimed in claim 15, further including applying an eighth pulse to all the scan electrode lines for removing the wall charges present at regions over the scan electrode lines.

19.The method as claimed in claim 18, wherein the eighth pulse has a moderate slope so as not to cause a discharge.

20. The method as claimed in claim 18, wherein the eighth pulse has a voltage identical to the voltage of the sixth pulse.

* * * * *